United States Patent [19]

Miller

[11] 4,137,842

[45] Feb. 6, 1979

[54] METHOD AND APPARATUS FOR APPLYING DECORATIVE IMPRINTS TO THE SURFACES OF PLASTIC WORKPIECES

[75] Inventor: Henry L. Miller, Mars, Pa.

[73] Assignee: Miller Screen & Design, Inc., Mars, Pa.

[21] Appl. No.: 773,393

[22] Filed: Mar. 2, 1977

[51] Int. Cl.[2] ..... B41N 1/24

[52] U.S. Cl. ..... 101/128.3; 96/36.4; 101/127; 427/264; 427/265; 427/270; 427/273; 427/282

[58] Field of Search ..... 427/282, 259, 264, 265, 427/270, 387, 273; 101/112, 127, 128.3, 129; 96/36.4

[56] References Cited

U.S. PATENT DOCUMENTS

| | | | |
|---|---|---|---|
| 2,064,764 | 12/1936 | Dlayford et al. | 101/128.3 |
| 2,131,225 | 9/1938 | Kirch et al. | 101/128.3 |
| 2,887,367 | 5/1959 | Eisner | 156/659 |
| 2,957,779 | 10/1960 | Belton | 427/259 |
| 3,023,122 | 2/1962 | dePataky | 427/282 |
| 3,246,598 | 4/1966 | Satonick | 101/128.3 |
| 3,342,624 | 9/1967 | Kamborian | 427/282 |
| 3,628,996 | 12/1971 | Weber | 427/387 |
| 3,672,934 | 6/1972 | Larry | 427/259 |
| 3,989,609 | 11/1976 | Brack | 427/54 |

*Primary Examiner*—Michael F. Esposito
*Assistant Examiner*—Janyce A. Bell
*Attorney, Agent, or Firm*—Thomas H. Murray; Clifford A. Poff

[57] ABSTRACT

System for applying decorative imprints to the surfaces of plastic workpieces by means of a heated silk-screen technique wherein the screen is initially coated with a silicone release agent which prevents sticking of the heated screen to the plastic workpiece and facilitates its easy removal from the workpiece while at the same time insuring good deposition of the printed material.

4 Claims, 3 Drawing Figures

METHOD AND APPARATUS FOR APPLYING DECORATIVE IMPRINTS TO THE SURFACES OF PLASTIC WORKPIECES

BACKGROUND OF THE INVENTION

Systems, such as that described in U.S. Pat. No. 3,399,165, have been devised for applying decorative imprints to articles formed from polyethylene and the like by the silk-screen method. The coating material or paint used is thermally responsive and is heated prior to its being poured into a stencil frame from where it is forced through an opening or openings in a paint-impervious layer on the screen by means of a squeegee or the like. For the successful operation of the process, it is necessary to pass an electrical current through the metallic mesh forming the screen so as to heat the same and prevent premature hardening of the coating material. This gives rise to a problem in that the heated screen tends to stick to the polyethylene article, with the result that when the screen is pulled away from the article to be printed on, a somewhat less than satisfactory deposition of the printed material results. In particular, the coating material or paint appears to adhere to the wire mesh forming the screen as it solidifies in contact with the polyethylene article instead of passing cleanly through the screen with the result that the printed pattern does not have an even coating of paint thereon.

SUMMARY OF THE INVENTION

In accordance with the present invention, the foregoing problem of sticking is eliminated by applying to the entire lower surface of the silk screen a silicone release agent having a melting temperature above that to which the screen is heated. Preferably, the silicone release agent, in a suitable solvent, is applied over the entire lower surface of the silk screen including the openings forming the pattern to be printed. If it is simply permitted to air-cure with the release agent thus applied, the release agent will clog the openings in the wire mesh through which the coating material normally passes. Accordingly, before curing, a solvent is passed through the opening forming the desired pattern from the side of the screen opposite that which contacts the plastic article to be decorated. This removes, or at least partially removes, the release agent adhering to the screen in the area of the openings forming the desired pattern. It is believed, however, that at least some residue of the release agent adheres to the individual strands forming the wire mesh in the area of the openings. This facilitates passage of the printing medium through these openings during a printing operation without adhesion whereby a more satisfactory and uniform printed design is produced.

The above and other objects and features of the invention will become apparent from the following detailed description taken in connection with the accompanying drawings which form a part of this specification, and in which.

Figure 1:
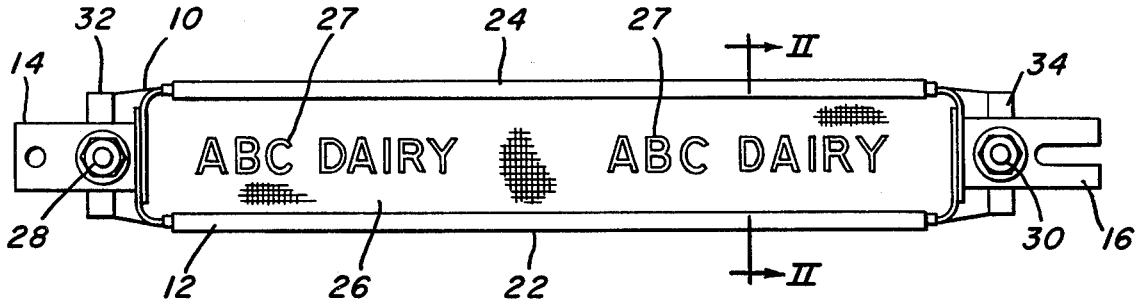
FIG. 1 is a top view of a stencil screen frame having a screen inserted therein.
Figure 2:
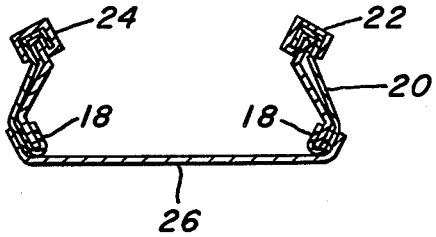
FIG. 2 is a cross-sectional view taken along line II—II of FIG. 1.

With reference now to the drawings, and particularly to FIG. 1, there is shown a stencil screen frame comprising two side pieces 10 and 12 brought together at their ends to form a rectangular trough and spot-welded or otherwise securely fastened to tabs 14 and 16 which facilitate the mounting of the screen on a decorative machine, not shown. Around the bottoms of the members 10 and 12, as best shown in FIG. 2 is a rubber or the like gasket 18. A strip of impregnated fabric 20 has one edge crimped into clip members 22 and 24 fitted over the tops of the members 10 and 12 and has a lower edge cemented or otherwise suitably joined to the sides of a screen 26 which preferably comprises a wire mesh of stainless steel.

In the assembly of the device, the clip members 22 and 24 are slipped over the tops of the members 10 and 12. The ends of the screen are then secured to the tabs 14 and 16 by means of bolts 28 and 30 which pass through openings in metal tabs 32 and 34 crimped to the ends of the screen. The lower end of the strip 20 and the edges of the screen 26 are then cemented to the outer peripheral surfaces of the gasket 18. Prior to the time that the screen 26 is secured to the frame shown in FIGS. 1 and 2, it is coated entirely with a photographic emulsion which, when exposed and thereafter developed, forms a paint impervious surface. However, by blocking light from portions of the screen during the development process, those portions of the photographic emulsion will not be developed and will wash away, thereby forming a desired pattern 27 which, in the example given in FIG. 1, identifies a dairy. Thus, the completed screen comprises a mesh of stainless steel filaments covered over its entire area, except that exposed by the desired design, with a paint-impervious layer.

Figure 3:
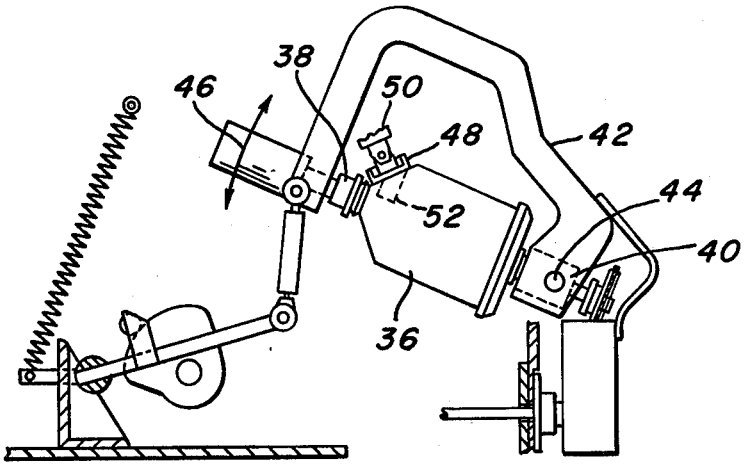
FIG. 3 illustrates one manner in which the screen of FIG. 1 can be used to produce a decorative imprint on a plastic workpiece.

A typical use of the invention is shown in FIGS. 3 wherein a plastic workpiece, such as a plastic milk bottle 36, is mounted in a chuck between opposing jaws 38 and 40 carried on a generally C-shaped frame 42. The frame 42 is pivoted as at 44 and can reciprocate in opposite directions indicated by the double-ended arrow 46. Above the workpiece 36 is a stencil screen frame, generally indicated by the reference numeral 48 and of the type shown in FIGS. 1 and 2. It is filled with a paint or decorating material such as that described in U.S. Pat. No. 3,339,165 such that when the workpiece 36 is rotated in the position shown, the stencil screen frame 48 can be caused to reciprocate whereby a squeegee 50 will force the paint material through the openings in the screen to produce a pattern or design 52 on the workpiece 36.

As was explained above, the printing material or paint must be heated prior to insertion into the trough formed by the stencil screen frame 48. Furthermore, it is necessary to heat the screen itself as by connecting electrodes to the two tabs 14 and 16 shown in FIG. 2. In the past, there has been a tendency of the hot screen, when contacting the workpiece 36, to stick to the same. Furthermore, there is tendency for the paint, in passing through the fine openings in the wire screen mesh, to freeze within the mesh rather than be deposited on the polyethylene workpiece. As a result, the application of paint to the workpiece is uneven.

In accordance with the present invention, these problems are overcome by initially applying to the undersurface of the screen a coating of a silicone release agent. Various types of silicone release agents may be employed, just as long as they will not melt below the temperature to which the screen is heated, however, Dow-Corning Types 96-005, 92-048 and 236 have been found to be particularly suitable. In the practice of the invention, the silicone release agent, in a suitable solvent, is painted or sprayed onto the undersurface of the screen and permitted to cure, either by way of an air-dry or by artificial heating, the only difference being that the air-dry requires a longer period of time for curing. Before curing, however, a solvent such as naphtha is caused to pass through the openings formed by the design in the screen so as to wash away the major portion of the release agent in these areas. Preferably this is done by causing the solvent to flow through the openings 7 from the side opposite the applied release agent. Otherwise, the openings in the screen in these areas would be clogged and no paint would pass therethrough. It is believed that while most of the release agent is washed away by the solvent in passing through the openings forming the design, a small film of the release agent remains on the filaments in the area of the openings; and this facilitates passage of the paint or printing material through the openings without adherence to the screen.

Alternatively, it is possible to paint the silicone release agent onto the area of the screen other than those areas forming the openings therein; however this is a tedious process; it is difficult to form an exact border around the design; and the method is not preferred.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In the method of applying decorative imprints to the surfaces of plastic workpieces, the steps of:

photographically forming on stencil screen a paint-impervious layer having a paint-pervious opening therein defining a desired pattern to be imprinted, securing to a frame said stencil screen, coating the side of said stencil screen which contacts a workpiece with a silicone release agent such that all areas of said side are covered, passing a solvent through the areas of the screen forming said paint-pervious opening to remove therefrom at least the major part of the coating of silicon release agent, and thereafter permitting said solvent to evaporate and said silicon release agent to cure, and contacting the surface of a plastic workpiece with the coating of silicon release agent to transfer paint forced through the paint-pervious openings in the screen onto the surface of a plastic workpiece.

2. The method of claim 1 wherein said step of covering includes covering the entire one side of the screen including said opening with a silicone release agent.

3. The method of claim 1 wherein said step of passing a solvent is further defined to include passing a solvent through said paint-pervious opening from the side of said stencil screen opposite to the side which contacts the workpiece.

4. In combination, a stencil screen frame, a stencil screen secured to one side of said frame, a paint-impervious layer on said screen having a paint-pervious opening therein defining a desired pattern to be imprinted, and a silicone release agent covering the side of said stencil screen which contacts said workpiece to be imprinted except said paint-pervious opening in the stencil screen.

* * * * *